US010989481B2

(12) United States Patent
Crawford et al.

(10) Patent No.: US 10,989,481 B2
(45) Date of Patent: Apr. 27, 2021

(54) HEAT EXCHANGER AND HEAT EXCHANGE SYSTEM

(71) Applicant: MODINE MANUFACTURING COMPANY, Racine, WI (US)

(72) Inventors: Mitchell Crawford, South Milwaukee, WI (US); Ashutosh Patil, Racine, WI (US); Andrew Boyer, Cudahy, WI (US); Daniel Raduenz, Franklin, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 181 days.

(21) Appl. No.: 16/099,637

(22) PCT Filed: May 18, 2017

(86) PCT No.: PCT/US2017/033273
§ 371 (c)(1),
(2) Date: Nov. 7, 2018

(87) PCT Pub. No.: WO2017/201252
PCT Pub. Date: Nov. 23, 2017

(65) Prior Publication Data

US 2019/0154346 A1 May 23, 2019

Related U.S. Application Data

(60) Provisional application No. 62/339,590, filed on May 20, 2016.

(51) Int. Cl.
*F28F 3/12* (2006.01)
*F28D 9/00* (2006.01)
(Continued)

(52) U.S. Cl.
CPC ..... *F28D 9/005* (2013.01); *F28D 9/0093* (2013.01); *F28F 9/027* (2013.01); *F28F 9/0253* (2013.01);
(Continued)

(58) Field of Classification Search
CPC .. F28D 9/005; F28D 9/0093; F28D 2021/008; F28D 2021/0089; F28F 9/0253;
(Continued)

(56) References Cited

U.S. PATENT DOCUMENTS 4,274,482 A 6/1981 Sonoda
5,146,980 A 9/1992 Le Gauyer
(Continued)

FOREIGN PATENT DOCUMENTS

EP 1611320 B1 12/2010
WO 2005124255 A1 12/2005

OTHER PUBLICATIONS

International Search Report and Written Opinion for Application No. PCT/US2017/033273 dated Sep. 18, 2017 (14 pages).
(Continued)

*Primary Examiner* — Claire E Rojohn, III
(74) *Attorney, Agent, or Firm* — Michael Bergnach; Jeroen Valensa

(57) ABSTRACT

A heat exchange system and apparatus for a vehicle powertrain configured to exchange heat between a first fluid and a second fluid within a heat exchanger core formed by a plurality of stacked plates having separate channels for the first fluid and the second fluid. The heat exchanger system includes multiple heat exchangers, one of which is connected to a both the inlet and the outlet of a vehicle powertrain component, another of which is fluidly connected or at least partially disconnected from the vehicle component according to the mode of operation of the heat
(Continued)

exchange system. The heat exchanger connected to the vehicle component includes a jumper tube to return the first fluid to the vehicle component through a core of the heat exchanger.

5 Claims, 9 Drawing Sheets

(51) Int. Cl.
*F28F 9/02* (2006.01)
*F28F 27/00* (2006.01)
*F28D 21/00* (2006.01)

(52) U.S. Cl.
CPC ..... *F28F 27/00* (2013.01); *F28D 2021/008* (2013.01); *F28D 2021/0089* (2013.01); *F28F 2250/06* (2013.01); *F28F 2280/06* (2013.01)

(58) Field of Classification Search
CPC ..... F28F 9/027; F28F 27/00; F28F 2250/06; F28F 2280/06
USPC ..... 165/168
See application file for complete search history.

(56) References Cited

U.S. PATENT DOCUMENTS 5,931,219 A * 8/1999 Kull ..... F28D 9/005 165/166
6,182,749 B1 2/2001 Brost et al.
6,918,434 B2 7/2005 Strahle
8,839,748 B2 * 9/2014 Kim ..... F28D 9/005 123/41.33
9,093,729 B2 * 7/2015 Wesner ..... F25B 39/022
9,121,643 B2 * 9/2015 Schaefer ..... H01M 10/6568
9,897,389 B2 * 2/2018 Denoual ..... F28D 9/0056
10,066,878 B2 * 9/2018 Huang ..... B60H 1/00342
10,174,976 B2 * 1/2019 Kim ..... F25B 40/00
2002/0129926 A1 * 9/2002 Yamaguchi ..... F28D 9/0012 165/41
2004/0112579 A1 * 6/2004 Strahle ..... F28F 9/0075 165/166
2005/0241814 A1 11/2005 Hendrix et al.
2006/0237184 A1 * 10/2006 Peric ..... F28F 27/02 165/283
2007/0261832 A1 * 11/2007 Ware ..... F28F 3/086 165/167
2008/0156466 A1 * 7/2008 Schmelz ..... F28D 9/0093 165/41
2009/0249810 A1 * 10/2009 Neumeister ..... F28F 9/0209 62/239
2010/0243200 A1 * 9/2010 Baker, Jr. ..... B60H 1/00342 165/41
2012/0152506 A1 * 6/2012 Otahal ..... F28F 9/0075 165/167
2012/0152516 A1 6/2012 Pineo et al.
2012/0234523 A1 * 9/2012 Jouanny ..... F28F 9/0246 165/166
2012/0291987 A1 * 11/2012 Himmer ..... F28F 3/025 165/42
2013/0160972 A1 * 6/2013 Sheppard ..... F28F 27/02 165/96
2013/0319634 A1 * 12/2013 Sheppard ..... F28F 27/00 165/96
2014/0150739 A1 * 6/2014 Kim ..... G05D 23/022 123/41.33
2015/0007970 A1 * 1/2015 Bader ..... F28F 3/08 165/166
2016/0131244 A1 * 5/2016 Patil ..... F16H 57/031 74/606 A
2016/0161192 A1 * 6/2016 Kim ..... F25B 40/00 165/167
2016/0282053 A1 * 9/2016 Bardeleben ..... F28F 9/0256
2016/0356205 A1 * 12/2016 Braun ..... F28D 9/0056
2018/0274406 A1 * 9/2018 Dries ..... F16H 57/0417
2019/0011198 A1 * 1/2019 Feldkeller ..... F28F 9/0246
2020/0141376 A1 * 5/2020 Mathieu ..... F01M 5/021

OTHER PUBLICATIONS

First Examination Report for Indian Patent Application No. 201817041606, Intellectual Property India, dated Dec. 20, 2019 (6 pages).

* cited by examiner

HEAT EXCHANGER AND HEAT EXCHANGE SYSTEM

CROSS REFERENCE TO RELATED APPLICATIONS

This application claims priority to U.S. Provisional Patent Application No. 62/339,590 filed May 20, 2016, the entire contents of which are hereby incorporated by reference herein.

BACKGROUND

The invention relates to vehicle powertrain heat exchangers and vehicle heat exchange systems for regulating the temperature of vehicle components depending on vehicle conditions and the temperature of heat exchanger fluids.

Vehicle heat exchange systems regulate the temperature of vehicle fluids and vehicle components to improve vehicle performance and provide a comfortable environment for vehicle passengers. Fluids circulate between heat exchangers and other vehicle components to cool a component, for instance, by cooling fluid, or to cool the fluid itself to maintain fluid properties. At certain times, such as vehicle start-up or in cold weather, cooling such fluids is not desirable, and the heat exchanger is not needed. Thermal control valves have been typically used between a heat exchanger and a vehicle component, then, to control the temperature of such fluids by controlling the amount of the fluid that circulates through the heat exchanger.

Such heat exchange systems include, among others, heat exchangers for engines, transmissions, electric vehicle batteries, and the fluids for these components. Oftentimes packaging for vehicle heat exchangers is one of the challenges encountered. Further, the demands on heat exchangers are becoming greater, as vehicle component performance requirements increase and cooling and heating needs increase with electric vehicles.

SUMMARY

A heat exchanger has, according to at least one embodiment of the invention, a core of stacked plates with flow channels for a fluid arranged between the plates and a first and second fluid manifold extending through the stack and fluidly communicating with at least some of the flow channels. The first manifold is at least partially defined by aligned apertures located in a first corner of the stacked plates, and the second manifold is at least partially defined by aligned apertures located in a second corner of the stacked plates. In some embodiments the first corner and the second corner are diagonally opposite one another, whereas in some other embodiments they are located along a common edge of the heat exchanger plates. In some embodiments at least one of the two fluid manifolds is in fluid communication with all of the flow channels for the fluid.

The heat exchanger also includes an inlet port and an outlet port arranged at one end of the heat exchanger, such as at the bottom end of the stack of plates, and another inlet and outlet port arranged at another end opposite that one end, for example at the top end of the stack of plates. Two flow paths for the fluid extend through the heat exchanger, and are fluidly isolated from each other within the heat exchanger. A first one of the fluid flow paths extends through the heat exchanger between the inlet port at the one end and the outlet port at the other end, and includes the flow channels, the first manifold, and the second manifold. A second one of the fluid flow path extends through the heat exchanger between the other inlet port and the other outlet port, and also extends through a jumper tube that extends through the aligned apertures in the second corner of the stacked plates.

In some embodiments the heat exchanger also has a third manifold, which is also at least partially defined be aligned apertures of the stacked plates that are located in the first corner. This third fluid manifold is also located along the first flow path, such that the first manifold and the third manifold are fluidly connected along the flow path by way of the flow channels and the second manifold. By way of example, a first subset of the flow channels can extend from one of the first and third manifolds to the second manifold, and a second subset of the flow channels can extend from the second manifold to the other one of the first and third manifolds. In this way, the fluid traveling along the first fluid flow path can make at least two passes through the stack of plates, with the second manifold functioning as a turn-around manifold for the fluid. Direct fluid flow between the first and third manifolds (i.e. bypassing the flow channels and the second manifold) can be prevented by a flow baffle that is provided in the first corner of one of the plates. Such a flow baffle can, by way of example, be realized by not including the aperture in that corner of that particular plate.

In at least come embodiments of the invention, the heat exchanger has a base that includes a flange plate and a channel plate. The base can be provided at one of the two ends of the stack that includes inlet and outlet ports, so that the fluid inlet port and the fluid outlet port at that end can be incorporated into the flange plate. The flange plate can also be provided with mounting features, such as mounting holes through which fasteners can extend, to enable the fastening of the heat exchanger to a vehicle powertrain component, such as a transmission. The channel plate can be arranged between the flange plate and the stack of plates, and can be joined to both the flange plate and the stack of plates. By way of example, the flange plate, the channel plate, and the stacked plates can all be made of a brazeable material (aluminum, for example) and can be joined together in a brazing process. The channel plate can have one or more channels arranged within it by, for example, removing material from the channel plate in select locations so that fluid can flow within the thickness of the channel plate, the adjoining flange plate and the immediately adjacent one of the stack of plates closing off the channel or channels. The base can also include additional intermediate plates arranged between the channel plate and the stack of plates, so that one of the additional intermediate plates closes off the channel or channels. The channel plate would thus be indirectly joined to the stack of plates.

In some embodiments, a channel arranged within the channel plate extends between a location that corresponds to the second corner of the plates and one of the ports (e.g. the inlet port or the outlet port) that is located at that end of the heat exchanger. The channel is thereby placed in fluid communication with that port and with either the second manifold or the jumper tube, so that one of the two fluid flow paths extends through the channel (i.e. the first one of the fluid flow paths extends through the channel if the channel is in communication with the second fluid manifold at that location, and the second one of the fluid flow paths extends through the channels if the channel is in communication with the jumper tubed at that location). In some such embodiments where the channel is in communication with the second fluid manifold, the jumper tube can extend through the channel and can be joined to the flange plate in a leak-free fashion, so that fluid passing through the jumper tube can be conveyed through the channel plate within the jumper tube.

In some other embodiments, the channel plate includes both a first channel through which the first fluid flow path extends, and a second flow channel through which the second fluid flow path extends. The first channel extends between one of the ports (e.g. the inlet port) that is located at that end of the heat exchanger and a location that corresponds to the first corner, so that the first channel is in fluid communication with the first manifold or the third manifold. The second channel extends between the other one of the ports (e.g. the outlet port) that is located at that end of the heat exchanger and a location that corresponds to the second corner. The second flow channel can be in fluid communication with the jumper tube at that second corner.

In at least some embodiments the stack of plates includes a bottom plate arranged at one end of the stack and a top plate arranged at the opposing end of the stack, and the jumper tube is joined in a leak-free fashion to at least one of the top plate and the bottom plate. In some such embodiments the jumper tube is joined only to one of those plates. Such an embodiment can be useful when it is desired for the fluid flow along the first flow path to transfer into or out of the stack of plates from or to the second manifold. In other such embodiments the jumper tube is joined to both the top plate and the bottom plate in a leak-free fashion. Such an embodiment can be useful when the top and bottom plates close off the second fluid manifold, so that flow into and out of the second fluid manifold only occurs by way of the flow channels between the plates.

The heat exchanger can optionally include a cover plate that is joined to the top plate of the stack. One or more connection blocks can be joined to the top plate, and the inlet port and outlet port at that end of the stack can be provided in the connection blocks. In some embodiments those ports are provided within a single connection block, whereas in other embodiments each of the two ports is provided in a separate connection block. The cover plate can optionally include one or more formed areas that define a flow channel or flow channels between the cover plate and the top plate. In some embodiments a flow channel fluidly connecting one of the ports at that end to the fluid manifold or manifolds at the first corner of the plates is thus provided. In other embodiments a flow channel fluidly connecting one of the ports at that end to the jumper tube is provided. In some embodiments, both such flow channels are provided.

According to another embodiment of the invention, a heat exchange system includes a vehicle powertrain component and a first heat exchanger directly attached to the vehicle powertrain component by way of a flange plate of the heat exchanger. The system also includes a thermal bypass valve and a second heat exchanger. A fluid circuit for a powertrain fluid extends through the vehicle powertrain component, the first and the second heat exchangers, and the bypass valve, and enters and exits the vehicle powertrain component only through the flange plate of the first heat exchanger.

In some embodiments the fluid circuit enters the first heat exchanger twice, once after the vehicle powertrain component and then again after the second heat exchanger, before returning to the vehicle powertrain component. In at least some embodiments the heat exchange system further includes a thermal bypass valve located in the fluid circuit between an outlet of the first heat exchanger and an inlet of the second heat exchanger. A bypass branch of the fluid circuit extends from an outlet of the thermal bypass valve to a location of the fluid circuit at a point between an outlet of the second heat exchanger and a second inlet of the first heat exchanger. The thermal bypass valve can therefore change the configuration of the fluid circuit by fluidly connecting or disconnecting the second heat exchanger in the fluid circuit.

In at least some embodiments the fluid circuit has a route that extends through the second heat exchanger before returning through the first exchanger to the vehicle powertrain component, and has another route that bypasses the second heat exchanger by returning to the first heat exchanger after leaving the thermal valve. Therefore, the thermal bypass valve has at least two modes to vary a flow of a fluid from the first heat exchanger to the second heat exchanger. At least one of the modes increases the flow of the fluid from the first heat exchanger to the second heat exchanger, and at least one other mode decreases the flow of the first fluid from the first heat exchanger to the second heat exchanger by diverting at least part of the flow of the fluid back to the first heat exchanger. In at least some embodiments the at least one other mode diverts all of the flow of the fluid back to the first heat exchanger so that effectively none of the fluid flows through the second heat exchanger in that mode.

The thermal bypass valve can be controlled within the valve itself by a material, such as a wax that expands and contracts to actuate the valve based on the temperature of the fluid. Alternatively, the valve can be controlled electronically by a computer processor that actuates the valve based on a computer program or user input, such as when the computer program or user determines that additional heat exchanger capacity is needed to regulate the temperature of the fluid In at least some embodiments the vehicle powertrain component is a vehicle transmission and the fluid is transmission oil. Towing a heavy load or other adverse driving conditions can, for example, prompt a determination that additional heat exchange capacity is needed. Additionally, according to some embodiments, a second fluid circuit extends through the first heat exchanger and connects the first heat exchanger to a radiator. Such a second fluid circuit can, for example, be a coolant fluid circuit.

According to some embodiments on the invention, the first heat exchanger includes a heat exchanger core that has a first plurality of fluid channels fluidly connected to and disposed between a first inlet manifold and a first outlet manifold, and a second plurality of fluid channels fluidly connected to and disposed between a second inlet manifold and a second outlet manifold. The first plurality of fluid channels are part of a first fluid circuit and the second plurality of fluid channels are part of a second fluid circuit. Further, the heat exchanger core can have a first inlet port located at a first end of the first inlet manifold, a first outlet port located at an end of the first outlet manifold, a second inlet port located at an end of the second inlet manifold, and a second outlet port located at an end of the second outlet manifold. A third inlet port is located proximal to a second end of the first inlet manifold and a third outlet port located proximal to the first end of the first inlet manifold. A top plate is located at or near the first outlet port, the second inlet port, the second outlet port, and the third inlet port. A bottom plate is located at or near the first inlet port and the third outlet port. A conduit extends from the third inlet port through the first inlet manifold to the third outlet port.

According to some embodiments, the second fluid circuit extends through the first heat exchanger to one or more vehicle components.

In some embodiments, a third fluid circuit extends through the second heat exchanger and fluidly connects the second heat exchanger to one or more vehicle components. In some embodiments, a fourth fluid circuit extends through the second heat exchanger to at least one of a plurality of vehicle components.

According to another embodiment of the invention, a method of cooling a fluid for a vehicle powertrain includes the steps of receiving a heated flow of powertrain fluid from a vehicle powertrain component into a first inlet port of a heat exchanger at a first temperature, circuiting the flow of powertrain fluid through the heat exchanger to thereby transfer heat from the powertrain fluid to flow of coolant, and directing the flow of powertrain fluid from a first outlet port of the heat exchanger to a valve component at a second temperature that is lower than the first temperature. The flow of powertrain fluid is subsequently received back into the heat exchanger from the valve component through a second inlet port of the heat exchanger at a third temperature. The second and third temperature can be the same in at least some modes of performing the method, and the second and third temperatures can be different (i.e. the third temperature can be hotter or cooler than the second temperature) in at least some modes of performing the method. After being received back into the heat exchanger through the second inlet port, the powertrain fluid is again directed through the heat exchanger and is returned to the vehicle powertrain component through a second outlet port. The heat exchanger is preferably directly attached to the vehicle powertrain component at the location of both the first inlet port and the second outlet port.

In some embodiments the method includes directing the powertrain fluid at the second temperature from the valve to a second heat exchanger, heating or cooling the powertrain fluid from the second temperature to the third temperature, and receiving the flow of powertrain fluid back into the valve component from the second heat exchanger at the third temperature.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1A:
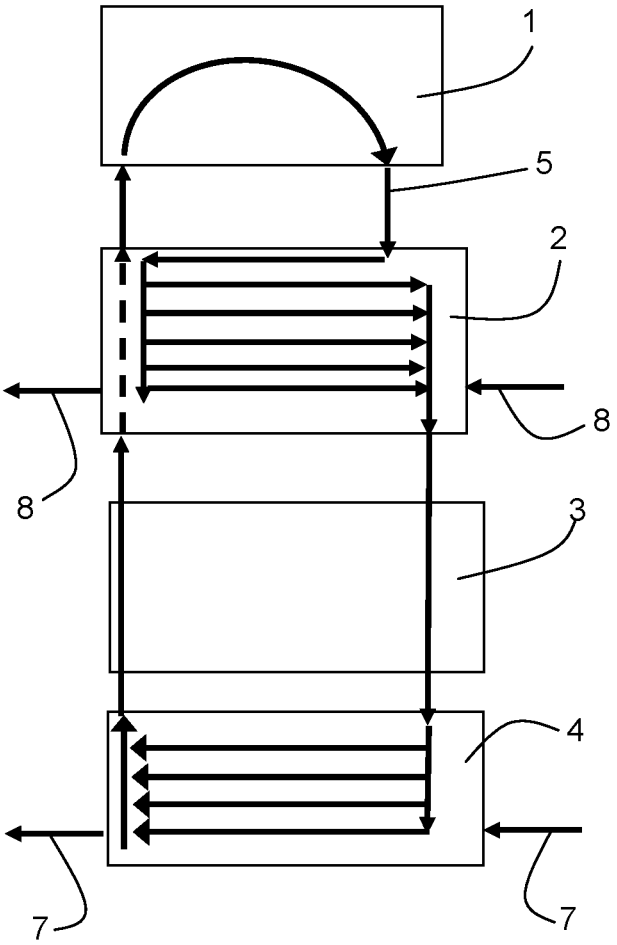
FIG. 1A is a schematic diagram of a heat exchange system of the current embodiment in one mode of operation.
Figure 1B:
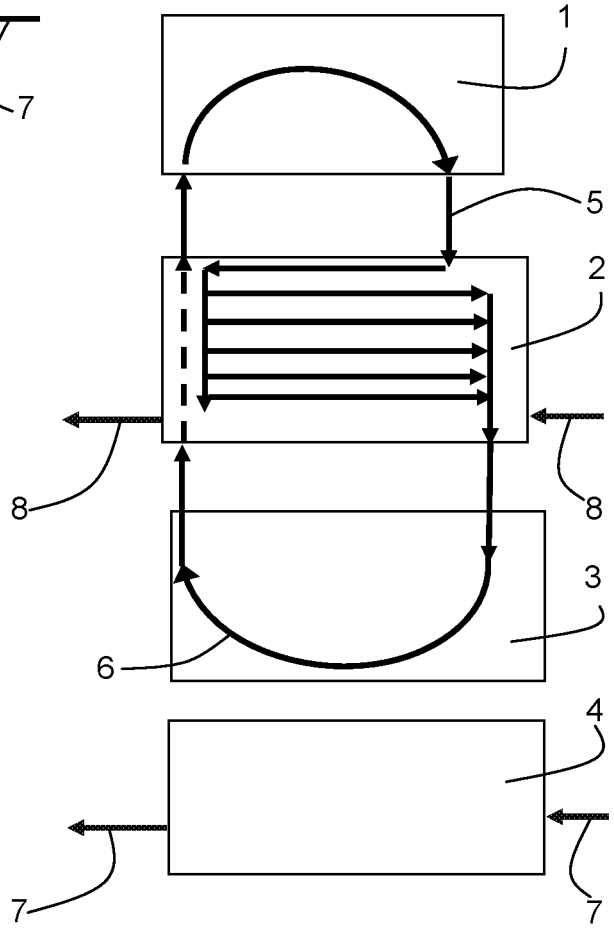
FIG. 1B is a schematic diagram of the heat exchange system of the current embodiment in another mode of operation.

A heat exchange system embodying the present invention is shown in FIGS. 1A and 1B, and can allow for a more flexible vehicle powertrain cooling system through providing variable cooling capacity in a compact system. Moreover, the flexibility of such a system can enable it to be used in other vehicle application, such as battery cooling and heating for example.

As shown in FIGS. 1A and 1B, the heat exchange system of the exemplary embodiment includes a transmission 1, a first heat exchanger 2, a thermal control valve 3, and a second heat exchanger 4, which are all fluidly connected by a first fluid circuit 5. The first fluid circuit 5 contains a first fluid, which, in the exemplary embodiment, is a transmission fluid. The first fluid circuit 5 extends from the transmission 1 through the heat exchangers 2, 4 and returns to the transmission 1. More specifically, the first fluid circuit 5 exits the transmission 1, then enters the first heat exchanger 2, where the first fluid circuit 5 is in heat exchanging arrangement with a second fluid circuit 8 that also passes through the first heat exchanger 2. After exiting the first heat exchanger 2, the first fluid circuit 5 enters the thermal control valve 3.

In a first mode of operation, shown in FIG. 1A, the first fluid circuit 5 extends to the second heat exchanger 4, where the first fluid circuit 5 is in heat exchanging arrangement with a third fluid circuit 7 that also passes through the second heat exchanger 4. From the second heat exchanger 4, the first fluid circuit 5 then returns to the transmission 1, passing again through the first heat exchanger on the way. When returning from the second heat exchanger 4, the first fluid circuit 5 can pass again through the thermal control valve 3, as shown in FIG. 1A, although it need not do so.

FIG. 1B depicts a second mode of operation of the heat exchange system. The second mode of operation can be particularly useful when the system requires less cooling capacity. In order to reduce the extent to which it is cooled, the first fluid circuit bypasses the second heat exchanger 4 in this mode of operation. The thermal control valve 3 diverts the first fluid circuit 5 through a bypass portion 6 that connects a location of the first fluid circuit 5 within or adjacent to the thermal control valve 3 with a location of the first fluid circuit 5 after the second heat exchanger 4 and before the first heat exchanger 2. From that location, the first fluid circuit 5 extends through the first heat exchanger 2 and returns to the transmission 1. When the thermal control valve 3 is activated to bypass the second heat exchanger 4, the first fluid circuit 5 is shortened to return most or all of the first fluid to the transmission 1 after having passed through the first heat exchanger 2.

In at least some embodiments, the first heat exchanger 2 is directly attached to the transmission 1 to provide a compact package for a vehicle. To accomplish such a small package, the first heat exchanger 2 can be provided with all of the connections necessary for the transmission 1 to connect to the heat exchange system. Therefore, the first fluid circuit 5 leaves the transmission 1 through the first heat exchanger 2 and returns to the transmission 1 through the first heat exchanger 2.

The thermal control valve 3 can be actuated automatically by an internal material that expands and contracts in response to the temperature of the first fluid. It also or alternatively can be controlled manually by a user, who determines when more cooling capacity of the second heat exchanger is needed. A vehicle processor can also or alternatively control the thermal control valve 3 through the use of a computer program. The thermal control valve 3 can be directly connected to the first heat exchanger assembly 2 at a connection block, such as the connection block 12 of the embodiments of FIGS. 2A-8, for example. Alternatively, the thermal control valve 3 can be located remotely from the first heat exchanger assembly 2.

Figure 2A:
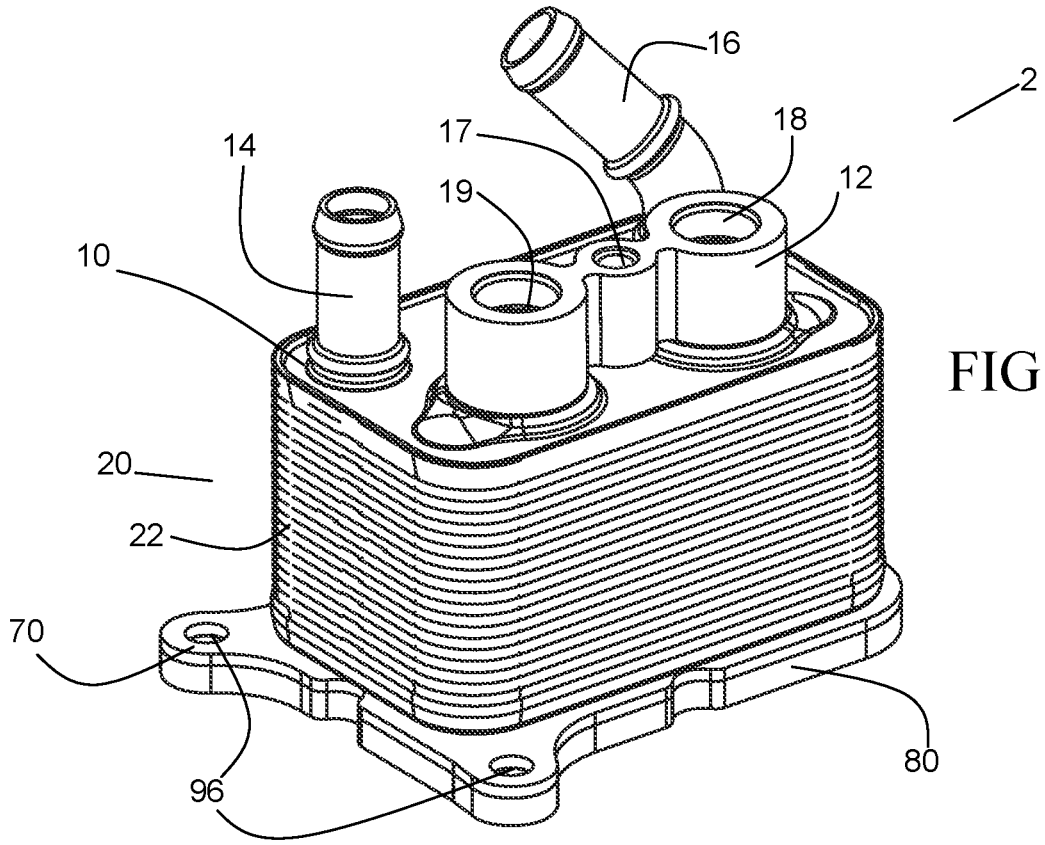
FIG. 2A is a perspective view of a heat exchanger according to an embodiment of the invention.
Figure 2B:
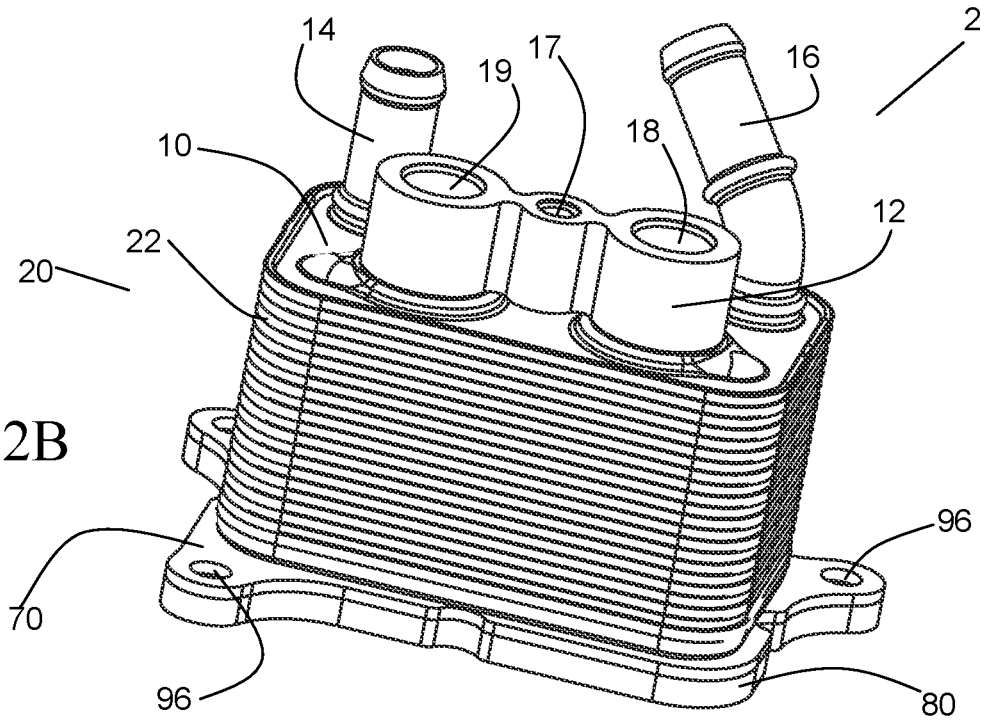
FIG. 2B is a perspective view at a different angle of the heat exchanger of FIG. 2A.
Figure 3:
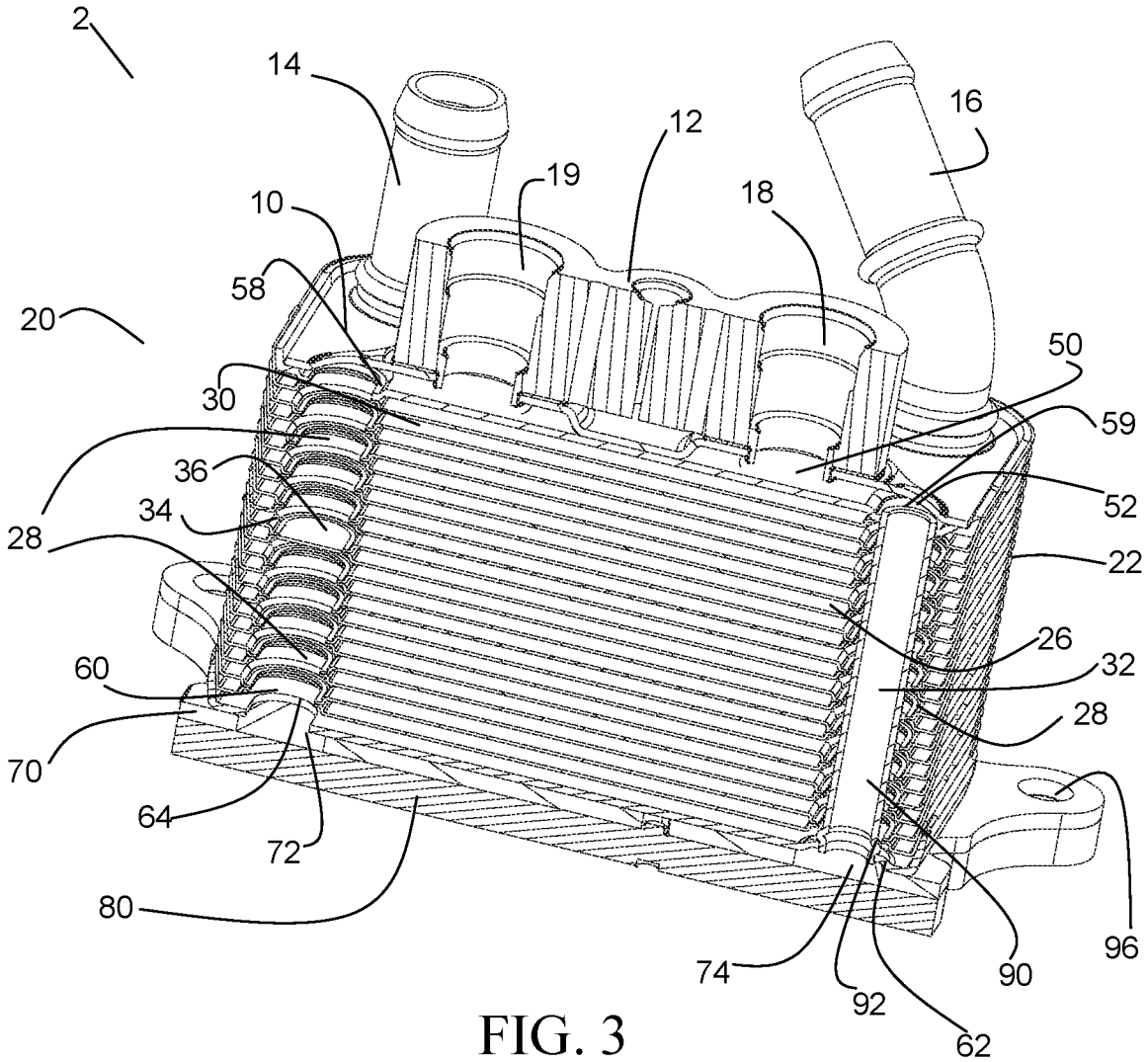
FIG. 3 is a sectioned perspective view of the heat exchanger of FIG. 2A.
Figure 4:
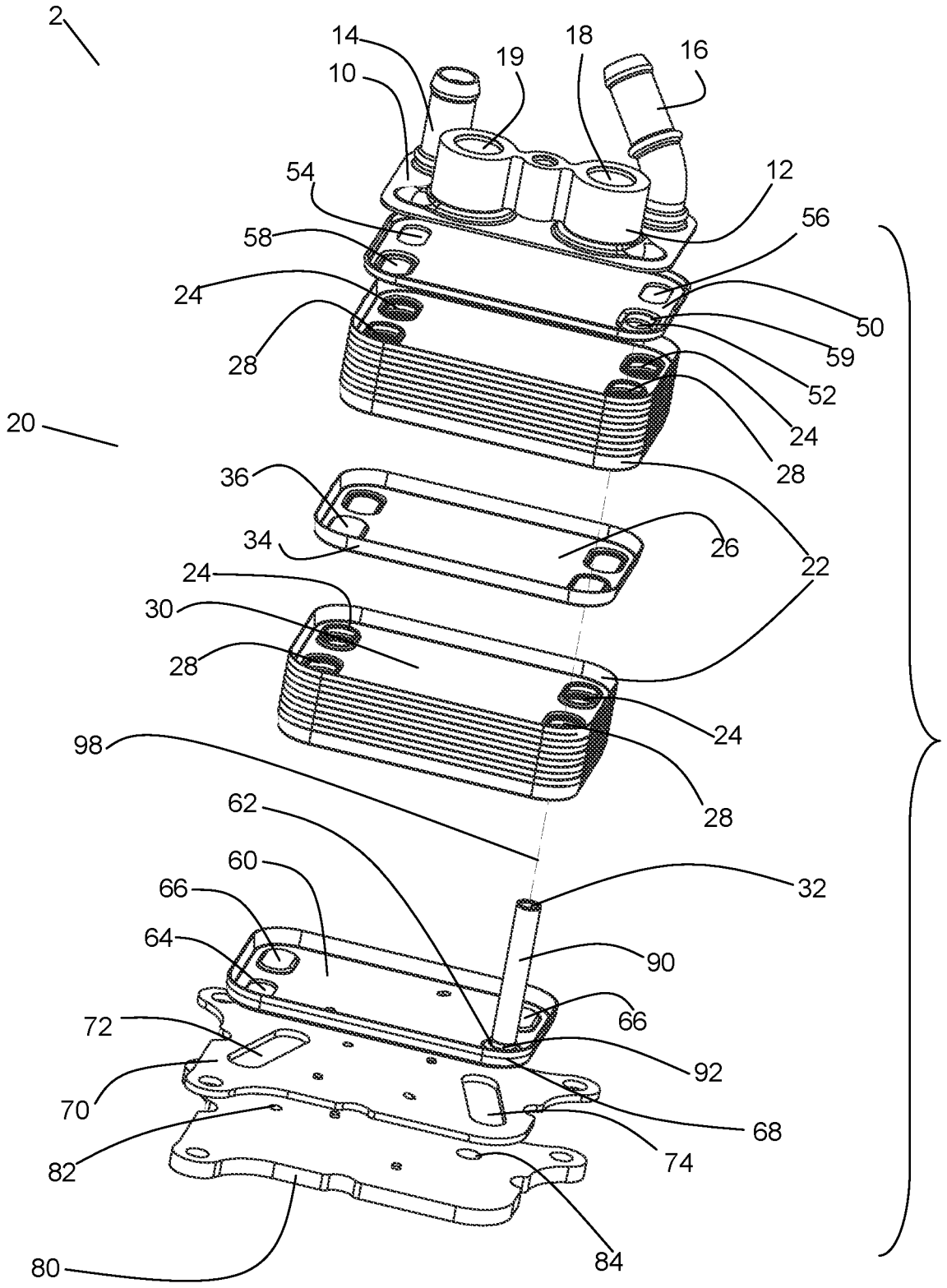
FIG. 4 is an exploded perspective view of the heat exchanger of FIG. 2A.

FIGS. 2A-8 depict one especially preferable embodiment of the heat exchanger 2. As shown in FIGS. 2A and 2B, the heat exchanger 2 is a layered core type heat exchanger including two fluid circuits for two separate fluids, which in the exemplary embodiment are a transmission fluid and a coolant fluid. The heat exchanger core 20 is constructed from core plates 22 that are stacked together to form first fluid channels 30 that alternate with second fluid channels 26, as best shown in FIG. 3. Manifolds 24, 28 respectively connect the second fluid channels 26 and the first fluid channels 30 to respective inlet 54, 64 and outlet 56, 58 ports for the second and the first fluids, as shown in FIG. 4.

In the exemplary embodiment, the core further includes a baffle plate 34 providing a manifold baffle 36 disposed within one of the manifolds 28 for the first fluid, as best shown in FIGS. 3 and 4. The baffle 36 can, but need not, be integrally formed within the baffle plate 34. The baffle 36 forces the first fluid to change direction through the core 20 and make multiple (in the exemplary embodiment, two) lateral passes through the core 20 before exiting the heat exchanger 2. In the exemplary embodiment, a baffle plate 34 is located within the core 20 at about the middle location along the height direction of the core 20, between two core plates 22. In alternative embodiments, the baffle plate 34 could be located at a different locations within the core 20, or there may be multiple baffle plates located at different positions within the core, or there may not be a baffle plate at all.

Figure 9:
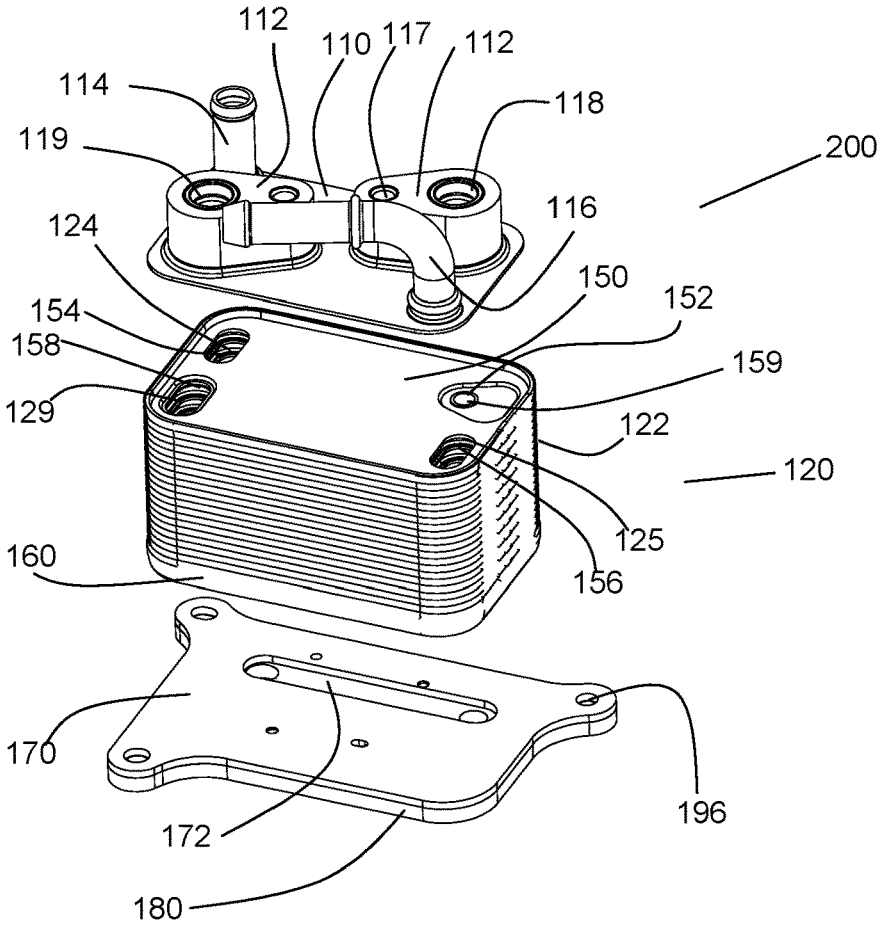
FIG. 9 is an exploded perspective view of a heat exchanger of another embodiment.

As further depicted in FIGS. 2A-5, a cover plate 10 is located on core 20 and has multiple cover plate holes (not numbered) for the first fluid and the second fluid. A first inlet fitting 14 and a first outlet fitting 16 are each attached to one of the cover plate holes. A connection block 12 is also attached to at least one of the cover plate holes. In the exemplary embodiment, the connection block 12 has a connection block inlet 18 and a connection block outlet 19 that are each fluidly connected to one of the cover plate holes, and the connection block 12 has at least one connection block fastener hole 17 for attaching fluid fittings (not depicted) or the thermal control valve to the connection block 12. In some embodiments, there are multiple connection blocks that are each connected to at least one of the cover plate holes, and one of the connection blocks has at least one of the connection block inlet and the connection block outlet, as shown in FIG. 9. The cover plate 10 is attached at several locations to a top plate 50 of the core 20 to form multiple cover plate channels (partially shown in FIG. 3, but not numbered) between the cover plate 10 and the top plate 50, each fluidly separated from one another. The cover plate channels include a first cover plate inlet channel, a first cover plate outlet channel, a second cover plate inlet channel and a second cover plate outlet channel.

Figure 5:
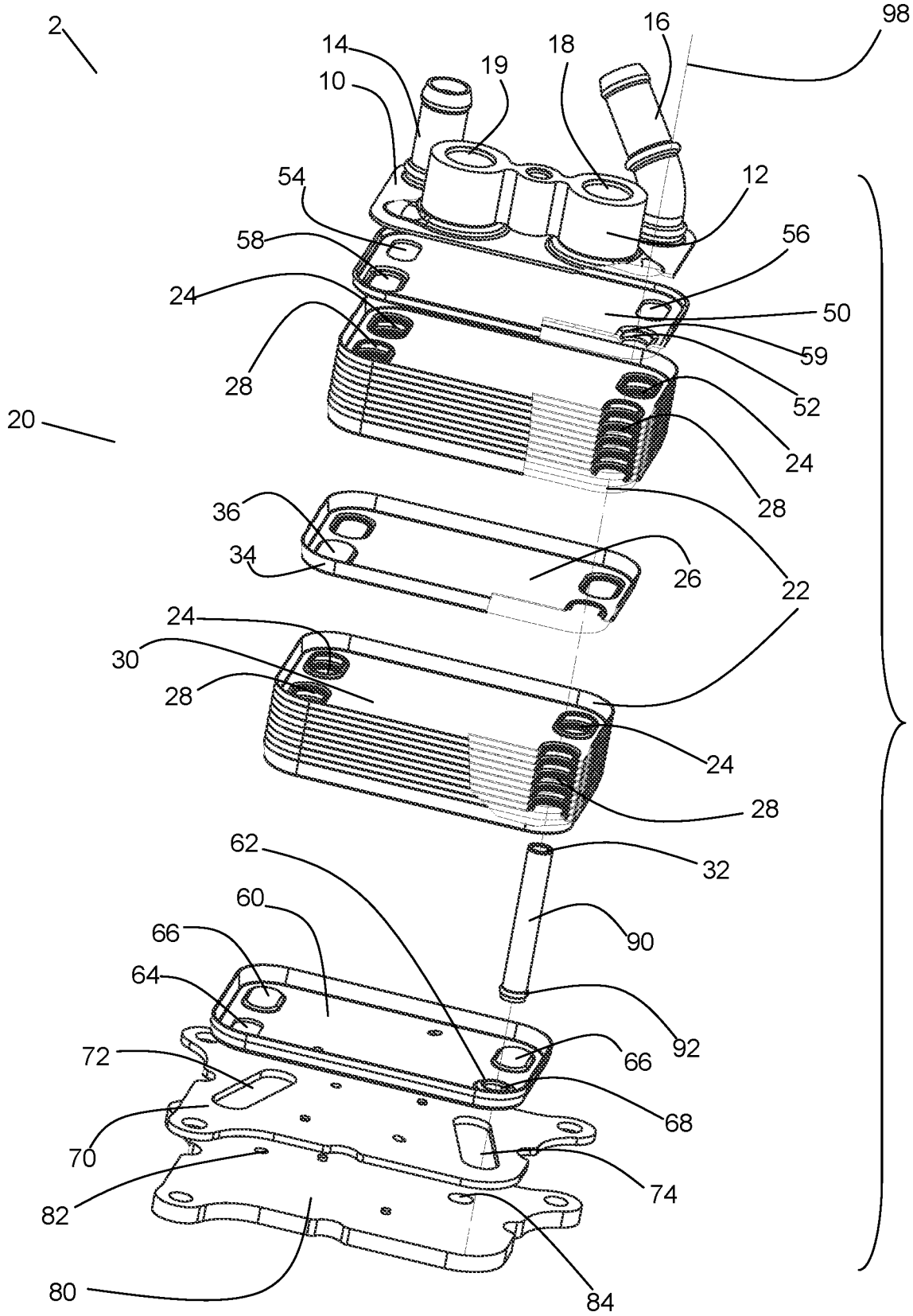
FIG. 5 is a partially sectioned, exploded perspective view of the heat exchanger of FIG. 2A.
Figure 6:
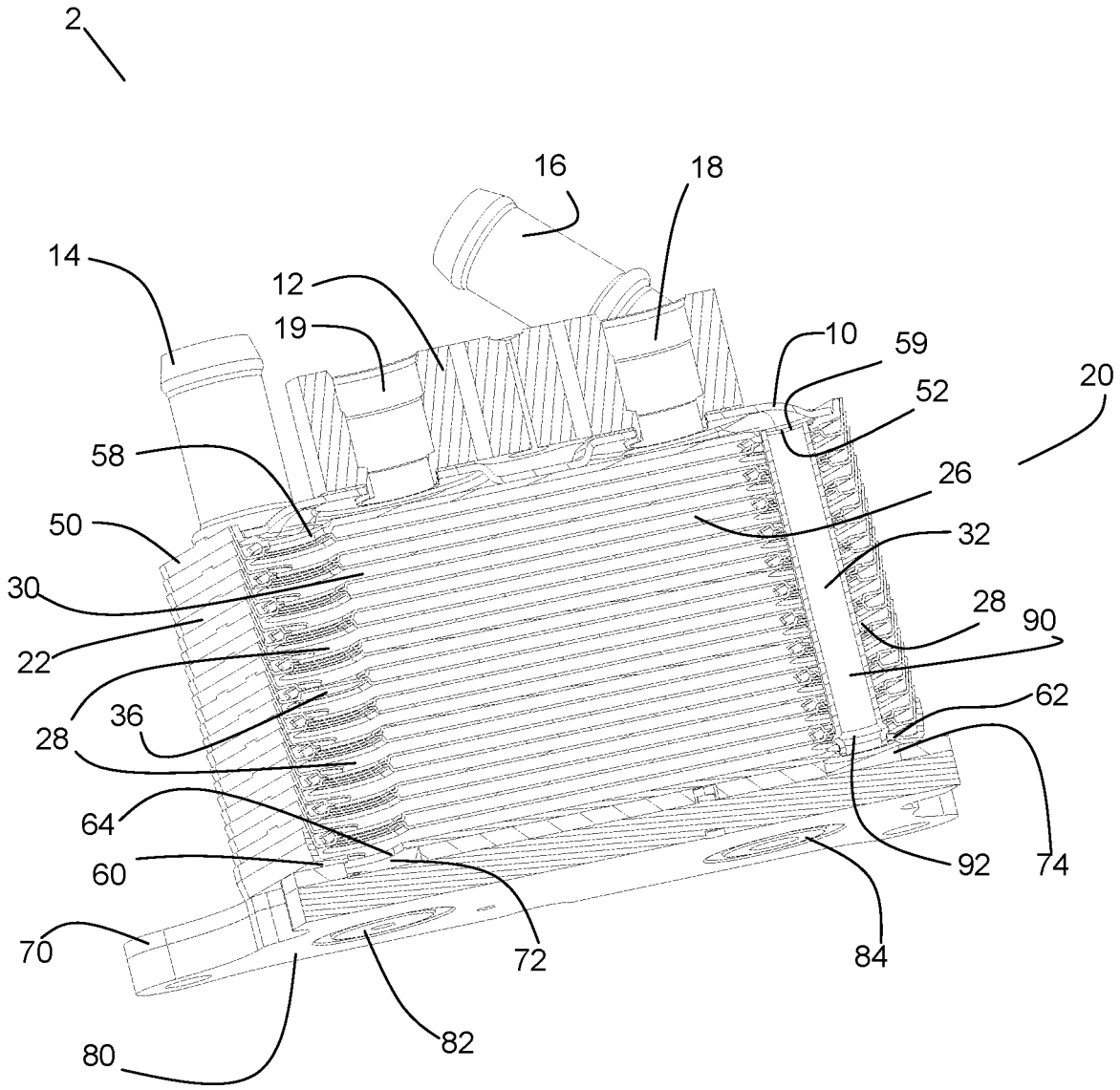
FIG. 6 is sectioned perspective view of the heat exchanger of FIG. 2A.
Figure 7:
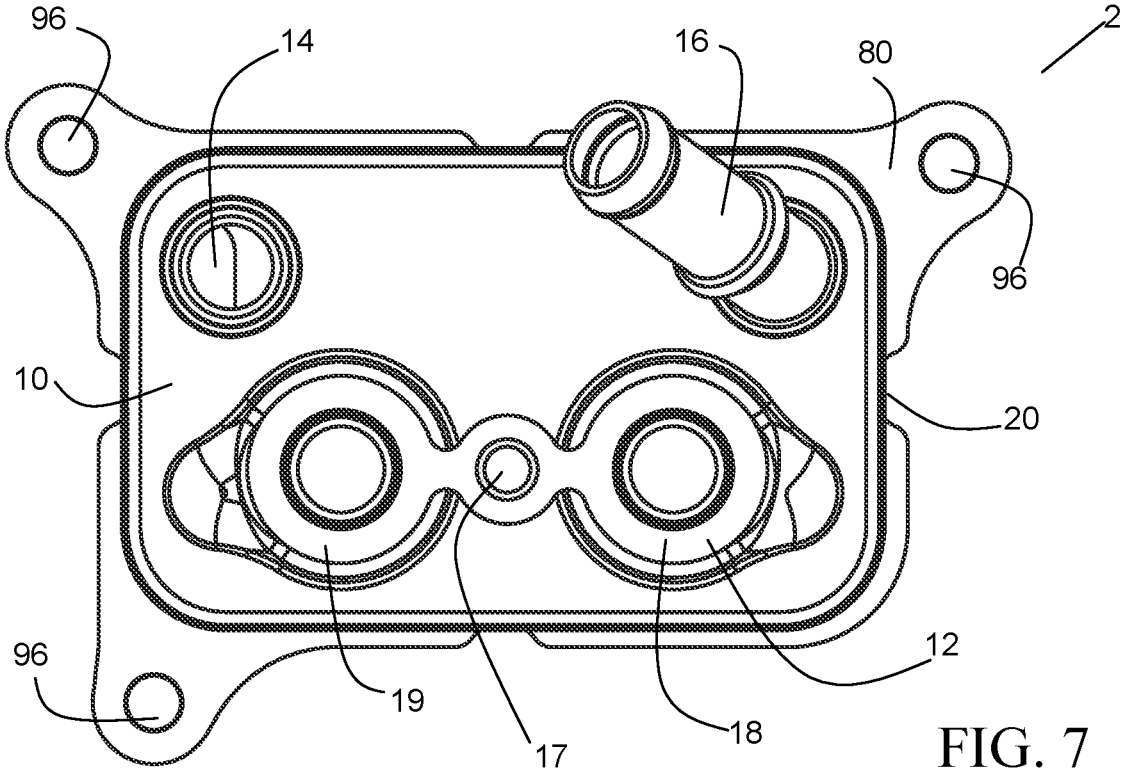
FIG. 7 is a plan view of the heat exchanger of FIG. 2A.
Figure 8:
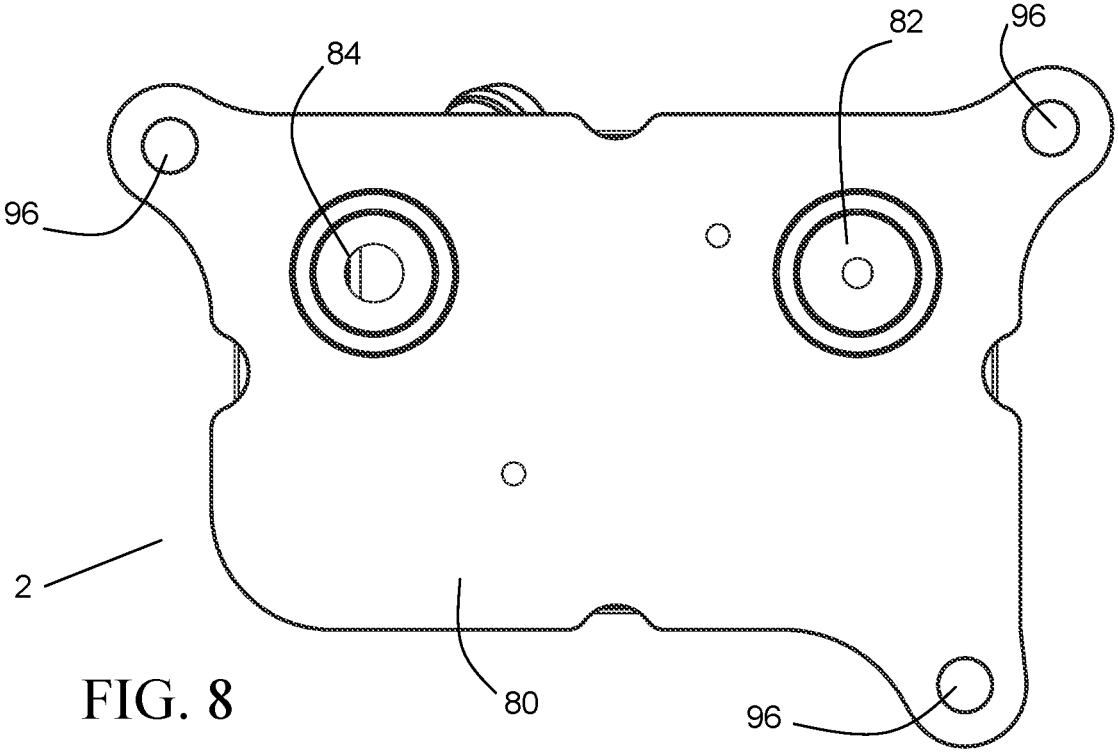
FIG. 8 is a bottom view of the heat exchanger of FIG. 2A.

Shown in FIGS. 2A-6 are also a channel plate 70 and a flange plate 80 attached to the core 20 opposite of the cover plate 10. In the exemplary embodiment, the assembly of the channel plate 70 and the flange plate 80 is configured to attach the heat exchanger both fluidly (through port connections 82, 84) and structurally (through bolt holes 96 to the transmission 1). The fasteners or bolts are not shown. The port connections include a flange inlet 82 and a flange outlet 84, as best shown in FIG. 6. The first fluid exits the transmission 1 at flange inlet 82 and enters the transmission 1 at flange outlet 84, which are both fluidly sealed to the transmission 1 (a seal 83 to provide the fluid seal between the flange plate and the transmission is shown in FIG. 11B). Flange inlet 82 is fluidly connected to the core 20 via a first channel 72, and the flange outlet 84 is fluidly connected to the core 20 via a second channel 74, both in the channel plate 70.

FIGS. 5 and 6 further show a top plate 50 disposed at the top of the core 20 and a bottom plate 60 disposed on the bottom of the core 20. The top plate 50 is located between the cover plate 10 and the core plates 22. The bottom plate 60 is located between the channel plate 70 and the core plates 22. Via the top plate 50 and the bottom plate 60, the core 20 includes several ports for the first fluid, defined here as a first inlet port 64, a second inlet port 59, a first outlet port 58 and a second outlet port 68, as well as several ports for the second fluid, defined here as a third inlet port 54 and a third outlet port 56. The bottom plate 60 further includes manifold caps 66 to cap the fluid manifolds 24 for the second fluid.

As shown in FIGS. 3-6, a jumper tube 90 extends through the core 20 and is attached to the top plate 50 by a top plate connection hole 52 and to the bottom plate 60 by a bottom plate connection hole 62 to bypass the first fluid channels 30 of the core 20. The jumper tube 90 extends through, and is fully contained within, one of the manifolds 28 for the first fluid. The first fluid is directed back to the transmission 1 after passing through the jumper tube 90 by passing through the outlet port 68 of the core 20 and through channel 74 before exiting to the transmission 1 through flange outlet 84. The jumper tube 90 is provided with a jumper tube bead 92 adjacent to the bottom plate connection hole 62 to help seal the jumper tube 90 to the bottom plate 60.

The jumper tube bead 92 can also facilitate assembly of the core 20. The jumper tube 50 can first be inserted into the bottom plate 60, with the bead 92 providing a stopping feature for the insertion. Then, the remainder of the core 20, including core plates 22, baffle plate 34, and top plate 50, can be inserted over the jumper tube 90 before the cover plate is attached to the top of the core 20. Without the jumper tube bead 92, it would be difficult for a technician or operator to assemble the core 20 with the jumper tube 90, as the jumper tube 90 would slide within the holes of the core 20 and might therefore not be precisely located.

Figure 10:
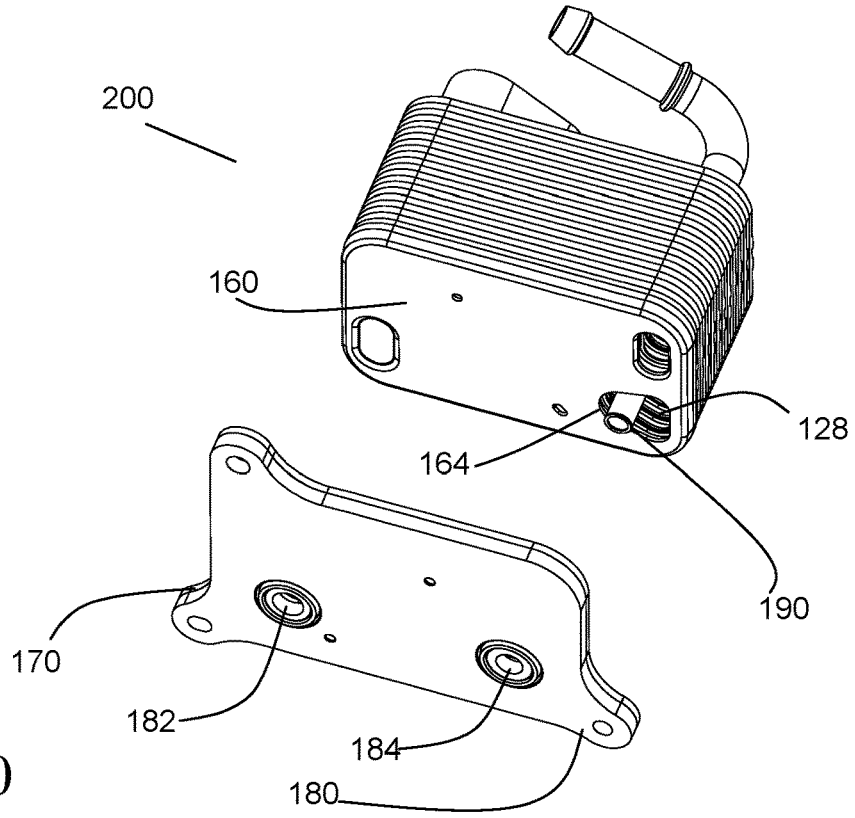
FIG. 10 is an exploded perspective view at a different angle of the heat exchanger of FIG. 9.

FIGS. 9 and 10 depict a heat exchanger 200 wherein the first and second fluids have diagonal flow patterns. To accomplish these diagonal flow patterns, the first fluid ports and the second fluid ports of the core 120 have been rearranged from the previously described embodiment. The cover plate 110 has holes that are attached to two connection blocks 112 (specifically, a connection block inlet 118 and a connection block outlet 119) and also has holes attached to a second fluid inlet fitting 114 and a second fluid outlet fitting 116. The connection blocks 112 include fastener holes 117 to function in the same way as the fastener hole 17 described previously.

A core 120 is formed by core plates 122, as shown in FIG. 9, without the inclusion of a baffle plate, although a baffle plate can be included in some embodiments. The core 120 includes first fluid channels that are connected by a first fluid inlet manifold 128 and a first fluid outlet manifold 129. The core 120 further includes second fluid channels at least partially disposed between the first fluid channels and fluidly connected by a second fluid inlet manifold 124 and a second fluid outlet manifold 125.

An assembled channel plate 170 and flange plate 180 connect the core 120 fluidly (by fluid ports 182, 184) and structurally (by bolt holes 196) to the transmission 1. The first fluid exits the transmission 1 and enters the flange plate 180 at flange inlet 182, and exits the flange plate 180 at flange outlet 184 before returning to the transmission 1. After entering the flange plate 180, the first fluid is channeled to the core 120 by channel 172 arranged within the channel plate.

The core 120 also includes several first fluid ports, including a first inlet 164, a second inlet 159, a first outlet 158, and a second outlet 168 (not depicted) and a several second fluid ports, including a third inlet 154 and a third outlet 156. A top plate 150 is located at the top of the core 120 and a bottom plate 160 is located at the bottom of the core 120.

A jumper tube 190 extending through the core 120 is attached to the top plate 150 at a top plate connection hole 152 and to the bottom plate 160 at a bottom plate connection hole 162. The jumper tube 190 extends through the first fluid inlet manifold 128 while remaining fluidly disconnected from that manifold 128 and the first fluid channels of the core 120. The first inlet 164 is disposed around the jumper tube 190.

The heat exchanger 20, 200 can alternatively be constructed by pre-assembling the jumper tube 90, 190 to the top plate 50, 150 and subsequently inserting the jumper tube 90, 190 into the manifold 28, 128 of the assembled stack of plates 20, 120. A variation of the previously described embodiments making use of such a construction method is shown in the cross-sectional views of FIGS. 11A and 11B.

Figure 11A:
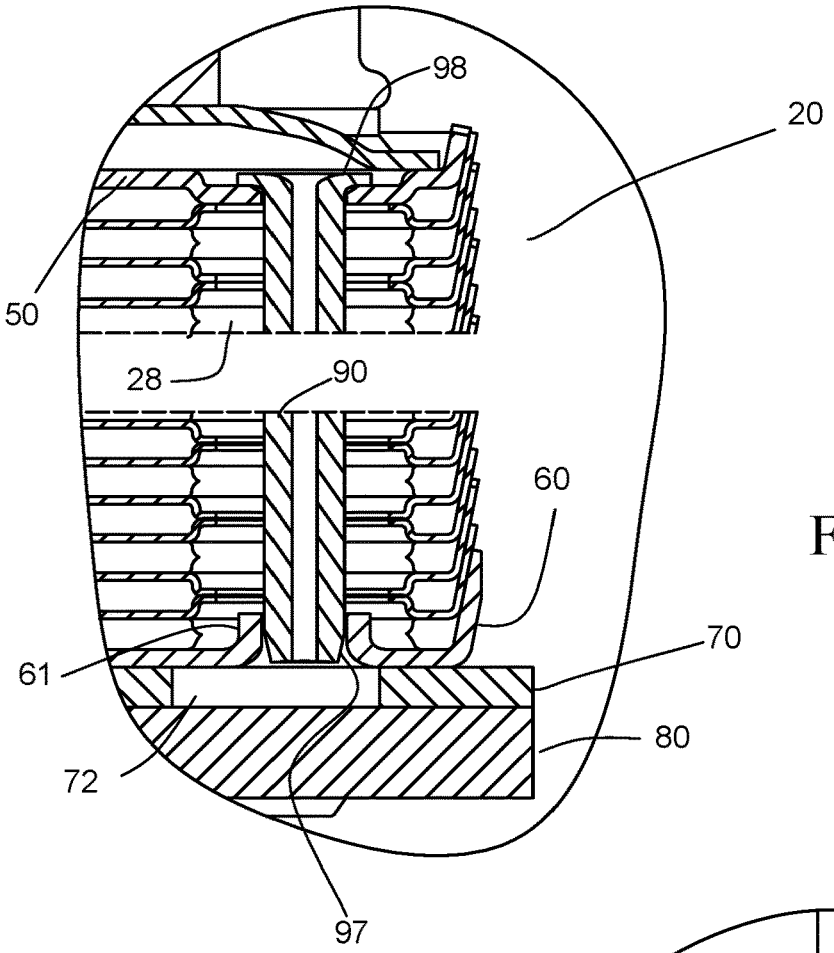
FIG. 11A is a partial broken cross-sectional view through a manifold of the heat exchanger of FIG. 2A showing an alternative construction.
Figure 11B:
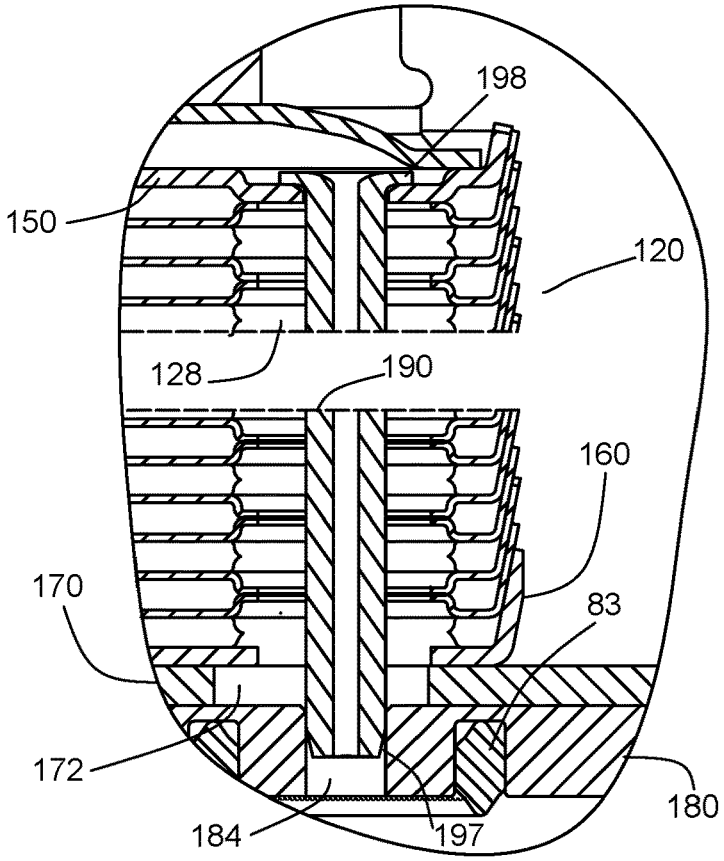
FIG. 11B is a partial broken cross-sectional view through a manifold of the heat exchanger of FIG. 9 showing an alternative construction.

FIG. 11A shows an alternative version of the heat exchanger 20, with an end of the jumper tube 90 being fluidly connected to the channel 74 within the channel plate 70. In that embodiment, the jumper tube 90 is provided with a flared-out end 98, which functions as a stop against the top plate 50. The jumper tube 90 is inserted through the top plate 50 until the flared-out end 98 engages against the top plate 50, and can be secured in position prior to brazing by a tack weld or the like. Alternatively, the flared-out end 98 can be formed into the jumper tube 90 after it has been inserted through the top plate 50 in order to mechanically lock the two parts together. An upturned flanged hole 61 is provided in the bottom plate 60, and the opposing end 97 of the tube 90 is received therein. The flange 61 provides a surface to which the outer periphery of the tube 90 can be brazed in order to provide a fluid seal between the manifold 28 and the channel 74, so that fluid traveling within the jumper tube 90 can be hydraulically isolated from the fluid passing through the manifold 28. The end 97 is chamfered to allow for the end of the tube 90 to readily seat within the flanged hole 61 when the top plate 50 is assembled to the stack of plates.

A similar method of assembly can be used when the jumper tube 190 connects directly to the outlet port 184 and when the fluid manifold 128 instead is fluidly connected to the channel 172 of the channel plate 170, as was the case in the embodiment of FIGS. 9-10. As shown in FIG. 11B, in such an embodiment the chamfered end 172 of the jumper tube 190 is received into the port 184 and is brazed thereto.

In some highly preferable embodiments, the first fluid is transmission oil and the second fluid is a coolant. In alternative embodiments, the first fluid could include engine oil, another powertrain fluid, another coolant, a battery coolant, or even a refrigerant, for cooling a vehicle component. The second fluid, in some alternative embodiments, could include a refrigerant, or a fluid to cool or heat another vehicle component, such a battery, passenger compartment heater, an electric motor, or an engine.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A heat exchanger comprising:

a core having a plurality of stacked plates, flow channels for a fluid arranged between the stacked plates;

a first manifold at least partially defined by first aligned apertures located in a first corner of at least some of the stacked plates, the first manifold being in fluid communication with a least some of the flow channels;

a second manifold at least partially defined by second aligned apertures located in a second corner of the stacked plates, the second manifold being in fluid communication with the flow channels;

a first inlet port and a first outlet port arranged at a first end of the heat exchanger;

a second inlet port and a second outlet port arranged at a second end of the heat exchanger opposite the first end;

a first fluid flow path extending through the heat exchanger between the first inlet port and the second outlet port, the first fluid flow path including the flow channels, the first manifold, and the second manifold;

a second fluid flow path extending through the heat exchanger between the second inlet port and the first outlet port, the first and the second fluid flow paths being fluidly isolated from one another within the heat exchanger;

a jumper tube extending through the second aligned apertures in the second corner of the stacked plates, wherein the second fluid flow path extends through the jumper tube;

a third manifold at least partially defined by third aligned apertures located in the first corner of at least some of the stacked plates, the third manifold being in fluid communication with a least some of the flow channels, the first fluid flow path extending through the third manifold, the first manifold and the third manifold being fluidly connected to each other along the first fluid flow path by way of the flow channels and the second manifold;

a flange plate arranged at the first end, the first inlet port and the first outlet port being provided in the flange plate;

a channel plate arranged between and joined to the flange plate and the plurality of stacked plates;

a first channel arranged within the channel plate and extending between the first inlet port and a location corresponding to the first corner of the plates, the first channel being in fluid communication with the first manifold and the first inlet port so that the first fluid flow paths extends through the first channel; and a second channel arranged within the channel plate and extending between a location corresponding to the second corner of the plates and the first outlet port, the second channel being in fluid communication with the jumper tube so that the second fluid flow path extends through the second channel.

2. A heat exchanger comprising:

a core having a plurality of stacked plates, flow channels for a fluid arranged between the stacked plates;

a first manifold at least partially defined by first aligned apertures located in a first corner of at least some of the stacked plates, the first manifold being in fluid communication with a least some of the flow channels;

a second manifold at least partially defined by second aligned apertures located in a second corner of the stacked plates, the second manifold being in fluid communication with the flow channels;

a first inlet port and a first outlet port arranged at a first end of the heat exchanger;

a second inlet port and a second outlet port arranged at a second end of the heat exchanger opposite the first end;

a first fluid flow path extending through the heat exchanger between the first inlet port and the second outlet port, the first fluid flow path including the flow channels, the first manifold, and the second manifold;

a second fluid flow path extending through the heat exchanger between the second inlet port and the first outlet port, the first and the second fluid flow paths being fluidly isolated from one another within the heat exchanger;

a jumper tube extending through the second aligned apertures in the second corner of the stacked plates, wherein the second fluid flow path extends through the jumper tube;

a flange plate arranged at the first end, the first inlet port and the first outlet port being provided in the flange plate;

a channel plate arranged between and joined to the flange plate and the plurality of stacked plates; and a channel arranged within the channel plate and extending between a location corresponding to the second corner of the plates and one of the first inlet port and first outlet port, the channel being in fluid communication with one of the second manifold and the jumper tube so that one of the first and second fluid flow paths extends through the channel.

3. The heat exchanger of claim 2, wherein the channel arranged within the channel plate is in fluid communication with the second manifold and wherein the jumper tube extends through the channel and is joined to the flange plate in a leak-free fashion.

4. A heat exchanger comprising:

a core having a plurality of stacked plates, flow channels for a fluid arranged between the stacked plates;

a first manifold at least partially defined by first aligned apertures located in a first corner of at least some of the stacked plates, the first manifold being in fluid communication with a least some of the flow channels;

a second manifold at least partially defined by second aligned apertures located in a second corner of the stacked plates, the second manifold being in fluid communication with the flow channels;

a first inlet port and a first outlet port arranged at a first end of the heat exchanger;

a second inlet port and a second outlet port arranged at a second end of the heat exchanger opposite the first end;

a first fluid flow path extending through the heat exchanger between the first inlet port and the second outlet port, the first fluid flow path including the flow channels, the first manifold, and the second manifold;

a second fluid flow path extending through the heat exchanger between the second inlet port and the first outlet port, the first and the second fluid flow paths being fluidly isolated from one another within the heat exchanger;

a jumper tube extending through the second aligned apertures in the second corner of the stacked plates;

a cover plate joined to the top plate; and one or more connection blocks joined to the cover plate, the second inlet port and the second outlet port being arranged in the one or more connection blocks, wherein the second fluid flow path extends through the jumper tube; wherein the plurality of stacked plates includes a bottom plate arranged at one end of the stack of plates and a top plate arranged at the opposing end of the stack of plates, the jumper tube being joined to at least one of the bottom plate and the top plate in a leak-free fashion, and wherein the cover plate includes one or more formed areas that define one or more cover plate flow channels between the cover plate and the top plate, the one or more cover plate flow channels including at least one of a flow channel fluidly connecting the second outlet port to the first manifold and a flow channel fluidly connecting the second inlet port to the jumper tube.

5. The heat exchanger of claim 4, wherein the jumper tube is joined to both the bottom plate and the top plate in a leak-free fashion.

* * * * *